US006931886B2

(12) United States Patent
Schuppisser et al.

(10) Patent No.: US 6,931,886 B2
(45) Date of Patent: Aug. 23, 2005

(54) APPARATUS FOR THE RETURN OF LUBRICANT FOR A REFRIGERATION MACHINE

(75) Inventors: Beat Schuppisser, Frauenfeld (CH); Jean-Claude Logel, La Wantzenau (FR); Beatrice Klotz, Brumath (FR); Holger Koenig, Oberndorf/Rottenburg (DE)

(73) Assignee: Axima Refrigeration GmbH, Lindau (DE)

( * ) Notice: Subject to any disclaimer, the term of this patent is extended or adjusted under 35 U.S.C. 154(b) by 0 days.

(21) Appl. No.: 10/699,601

(22) Filed: Oct. 30, 2003

(65) Prior Publication Data

US 2004/0134223 A1 Jul. 15, 2004

(30) Foreign Application Priority Data

Nov. 1, 2002 (EP) ..... 02405936

(51) Int. Cl.[7] ..... F25B 43/02
(52) U.S. Cl. ..... 62/470; 62/471
(58) Field of Search ..... 62/470, 471, 474, 62/475, 503, 512

(56) References Cited

U.S. PATENT DOCUMENTS

| | | | | |
|---|---|---|---|---|
| 1,899,378 A | | 2/1933 | Zouck et al. | |
| 5,996,372 A | * | 12/1999 | Koda et al. | 62/503 |
| 6,000,233 A | * | 12/1999 | Nishida et al. | 62/114 |
| 6,339,932 B1 | | 1/2002 | Yamaguchi et al. | |

FOREIGN PATENT DOCUMENTS

| | | |
|---|---|---|
| EP | 0 672 875 A2 | 9/1995 |
| EP | 0 887 603 A2 | 12/1998 |

* cited by examiner

*Primary Examiner*—Chen Wen Jiang
(74) *Attorney, Agent, or Firm*—Townsend and Townsend and Crew LLP

(57) ABSTRACT

In accordance with the invention an apparatus is proposed for the return of lubricant for a refrigeration machine (K). The lubricant return comprises a container (2) with at least one sheet metal partition (3), said sheet metal partition (3) dividing the container (2) into at least a first zone (4) and a second zone (5), as well as a sheet metal separating member (7) in the second zone for separating out lubricant (6). In the second zone (5) an extraction device (8) is arranged in relation to the sheet metal separating member (7) in such a way and formed so that the lubricant (6) separated out at the sheet metal separating member (7) is removable from the container (2) by means of the extraction device (8).

12 Claims, 2 Drawing Sheets

APPARATUS FOR THE RETURN OF LUBRICANT FOR A REFRIGERATION MACHINE

BACKGROUND OF THE INVENTION

The invention relates to an apparatus for the return of lubricant for a refrigeration machine and also to a refrigeration machine with an apparatus of this kind.

Refrigeration plants with refrigerants are usually operated with closed refrigerant circuits, in which a compressor sucks in gaseous refrigerant directly or indirectly from a vaporizer, compresses it and passes it on to a condenser, in which the compressed refrigerant is liquefied while giving up heat. The liquid refrigerant is then relaxed almost to vaporization pressure via a restrictor, in order to subsequently transfer back to the gaseous state in the vaporizer while taking up heat of vaporization.

Depending on the amount to be forwarded, volumetrically forwarding compressors or centrifugal compressors, for example, can be employed as the compressor and in each case friction losses can occur at bearings and dynamic sealing locations among other things. Refrigeration plants, which use carbon dioxide ($CO_2$) as a refrigerant for example, have almost always been operated with oil-free compressors in the past, which means without corresponding lubricant. Furthermore, lubricated compressors are also known which, for example, use soluble ester oil as a lubricant. The soluble ester oil can be returned via a thermosyphon pump, as is known in the case of FCKW refrigerants, for example.

However, non-soluble oils and lubricants are often better suited for the refrigerant circuit.

Thus it is known for example to operate refrigeration plants, which use ammonia as a refrigerant, with various mineral oils, which are practically insoluble in ammonia. These mineral oils display a high viscosity as a rule at low temperatures, which has the result that the separated out mineral oil, which is carried along in the stream of ammonia from the compressor, has to be removed from the refrigerant again via complicated oil separators, since it settles on cold wetted surfaces, impairs the heat transfer in the heat exchangers, has a disturbing effect in valves, regulating units and the like and, finally, has the tendency to settle out as a sump in the vaporizer.

Non-soluble oils such as PAO oils for example, which are lighter than the liquid refrigerant as a rule, are better suited as a lubricant than the liquid refrigerant $CO_2$. This kind of lubricant obviously also causes the problems which have been outlined in detail above and thus has to be continually removed from the refrigerant circuit.

SUMMARY OF THE INVENTION

An object of the invention is thus to suggest an apparatus for the return of lubricant for a refrigeration machine, which permits a lubricant with a lower density than that of the refrigerant employed in the refrigeration machine to be returned from the refrigeration circuit.

In accordance with the invention an apparatus for the return of lubricant for a refrigeration machine is thus suggested. The lubricant return comprises a container with at least one sheet metal partition, the sheet metal partition dividing the container into at least a first zone and a second zone, as well as a sheet metal separating member arranged in the second zone for separating out lubricant. An extraction device is arranged in the second zone in relation to the sheet metal separating member in such a way and is formed so that the lubricant separated at the sheet metal separating member is removable from the container by means of the extraction device.

The proposed lubricant return for a refrigeration machine thus allows a lubricant, which is lighter than the refrigerant used in the refrigeration machine, to be separated out from the actual refrigerant simply and reliably. The lubrication apparatus in accordance with the invention comprises a container, which acts as a liquid separator and is integrated into the refrigerant circuit. The liquid separator in this arrangement serves (as is usual in refrigeration plants) for the separating off of liquids which are contained in the wet suction gases of the vaporizers of the refrigeration machine.

The container, which can, for example, be formed as a hollow cylinder closed at both ends, is divided into a first zone and a second zone by at least one sheet metal partition. A mixture of refrigerant and lubricant loaded with lubricant is led to the second zone via a feed line, preferably directly from a vaporizer of the refrigeration machine, and the mixture is separated in the second zone of the container, as will be explained in more detail in the following, so that essentially lubricant-free refrigerant enters the first zone of the container and is collected there in the container in liquid form. In the operating state the liquid refrigerant can be removed by suction from the first zone via suitably arranged connection lines by refrigerant circulating pumps. In this arrangement the gaseous refrigerant phase is removed by suction from the first zone of the container via a further connection line by a compressor of the refrigeration machine and thus returned to the refrigerant circuit.

The above-mentioned sheet metal partition, which divides the container into a first zone and a second zone, is so designed and arranged in the container that a liquid, which is fed to the second zone of the container, can initially only fill the second zone of the container, which means that a certain quantity (pre-determinable by the design of the sheet metal partition) of the liquid fed to the second zone is retained by the sheet metal partition in the second zone. Only once a volume of added liquid, predetermined by the sheet metal partition and the geometry of the container, has been achieved in the second zone is an additionally supplied quantity of liquid able to overcome the sheet metal partition and thus reach the first zone of the container. By this means the level of refrigerant in the first zone of the container can fluctuate freely, by means of which an ideal degree of filling of the refrigerant circuit of the refrigeration machine is always guaranteed.

In this arrangement the sheet metal partition can either extend over just a part of the cross-section of the container, or however also cover the entire cross-section of the container. In this case the sheet metal partition has to have one or several suitably placed apertures, which allow the liquid to reach the second zone from the first zone.

The liquid mentioned above for a refrigeration machine is naturally a refrigerant contaminated with lubricant. The lubricant is preferably an oil which is essentially non-soluble in the refrigerant in the operating state, with carbon dioxide especially being used as the refrigerant here.

A sheet metal separating member for separating out lubricant from the refrigerant is arranged in the second zone in such a way that the second zone is divided into a separating out zone and an overflow zone, which guarantees that liquid from the separating out zone can reach the overflow zone. It is preferable, though not necessary, for the sheet metal partition member and the sheet metal separating member to be arranged parallel to one another. The overflow zone is thus located between the sheet metal partition and the sheet metal separating member, while the separating zone is defined by the remaining part of the second zone.

The sheet metal separating member is so designed and arranged that an essentially identical liquid level arises in the separating zone and the overflow zone, with the liquid level being predetermined by the design and arrangement of the sheet metal partition in the container. A mixture of refrigerant and lubricant loaded with lubricant, which is supplied to the separating zone in the second zone as described above, via a feed line from a vaporizer of the refrigeration machine, is separated under the influence of gravity in the separating zone, due to the different densities of the lubricant and refrigerant, into two layered liquid phases.

Thus the lubricant collects, because it has a lower density than the refrigerant, in a substantially single phase lubricant layer in the separating zone on the surface of the liquid which is formed by the pool of refrigerant. Thus the sheet metal separating member prevents the lubricant from reaching the overflow zone and thus the first zone. The lubricant floats on the liquid refrigerant and remains in the second zone. The sheet metal separating member thus secures the gravity separation in the second zone and serves as an aid to separation. Dry gaseous refrigerant, which reaches the second zone, is able to flow without hindrance into the first zone and to be sucked away by compressors as usual.

By this means the sheet metal partition guarantees a constant maintenance of the liquid level in the second zone, i.e. the position of the surface of the liquid which is formed by the pool of the refrigerant in the second zone. An excess of liquid, created by the liquid quantity of the injected refrigerant, will flow over into the first zone at very slow speed.

In the separating zone, an extraction device is provided at the level of the surface of the liquid, the position of which is determined by the sheet metal partition, with which the lubricant separated out at the sheet metal separating member is removable from the container.

In a preferred embodiment of the invention the extraction device comprises an extraction stub for receiving the lubricant, which can in particular be arranged eccentrically in relation to a longitudinal axis of the container. In this arrangement a sheet metal lubricant catcher can be additionally arranged to advantage between the sheet metal separating member and the extraction device, especially between the sheet metal separating member and the extraction stub. It has in particular an angled region formed as a rim, which is preferably circa 5 mm to 10 mm wide and which additionally assists the leading away of the lubricant. Additionally, the extraction device can comprise a collecting container for the lubricant, wherein the extraction stub is connected to the collecting container for the lubricant via a line. The collecting container can comprise further means and be designed in such a way that possible residues of the refrigerant can be separated out from the lubricant, and that refrigerant and lubricant can be returned separately from the collecting container into the lubricant circuit and into the refrigerant circuit of the refrigeration machine respectively.

In a further variant of an apparatus for the return of lubricant, the extraction device comprises a valve for the control and/or regulation of the amount of lubricant to be extracted from the container, the valve being provided in the line between the extraction stub and the collecting container and if necessary being operated via a control unit.

Furthermore, a pump can be provided between the extraction stub and the collecting container, which assists the removal of the lubricant from the separating zone of the container into the collecting container, wherein the pump can of course likewise be controlled and/or regulated via a control unit.

The invention further relates to a refrigeration machine, which comprises a lubricant return in accordance with the invention, as has been previously explained in some of the preferred embodiments. In a way particularly significant in practice, the invention relates to a refrigeration machine with a compressor and a vaporizer, wherein the lubricant return is arranged between the compressor and the vaporizer.

The invention will be explained more closely in the following, with the aid of the drawings.

DESCRIPTION OF THE PREFERRED EMBODIMENTS

Figure 1:
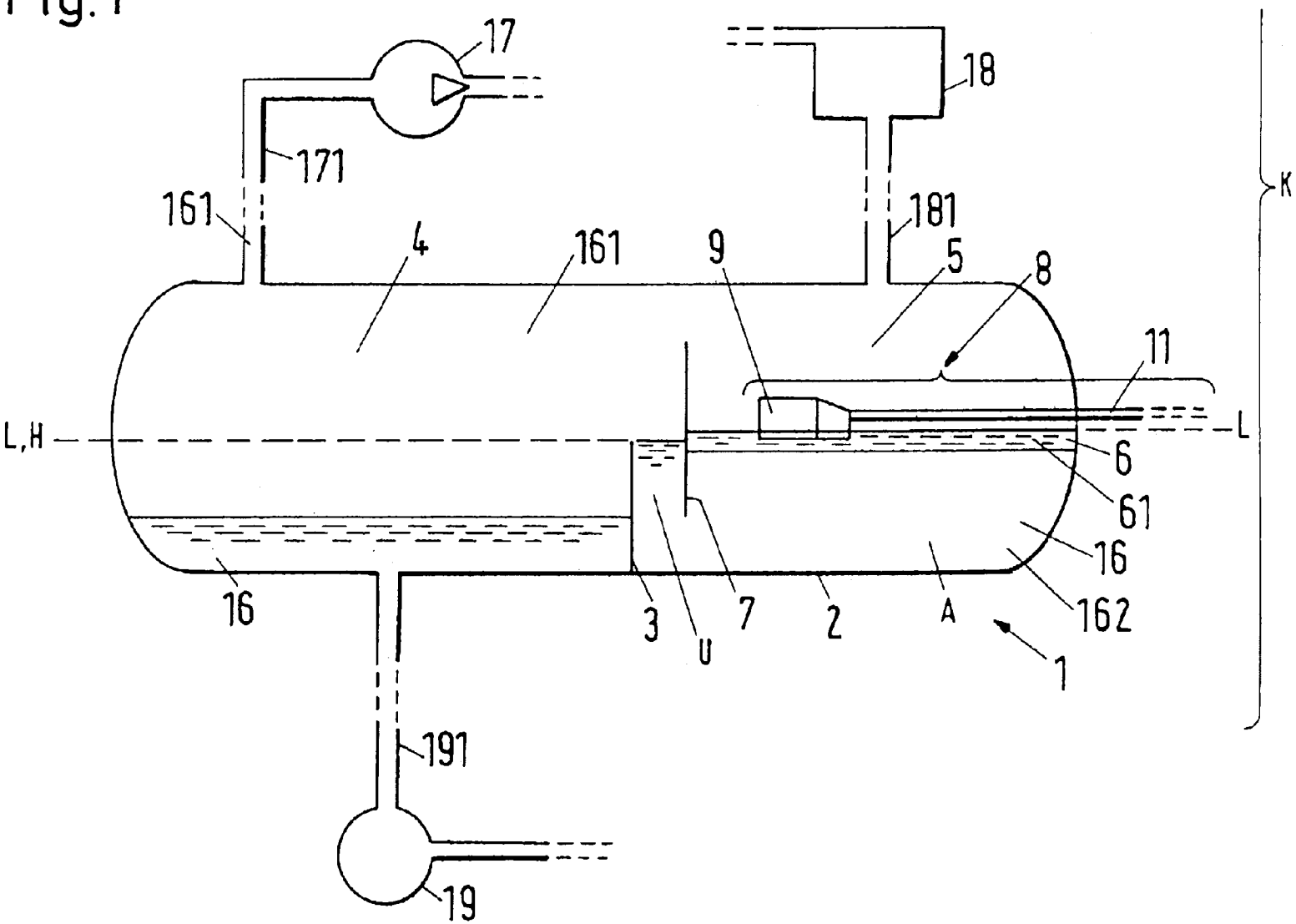
FIG. 1 shows essential parts of a refrigeration machine with an apparatus for the return of lubricant in a schematic illustration.

FIG. 1 shows schematically essential parts of a refrigeration machine K with an apparatus for lubricant return, which will be given the reference numeral 1 as a whole in the following. The refrigeration machine K comprises, as essential parts, a compressor 17, a condenser which is not illustrated here and a likewise not-illustrated restrictor device, a vaporizer 18, and also an apparatus for the return of lubricant 1, which is arranged between the compressor 17 and the vaporizer 18.

The apparatus for lubricant return 1 comprises a container 2, which as is illustrated here as an example is formed as a hollow cylinder closed at both ends and is divided by at least one sheet metal partition 3 into a first zone 4 and a second zone 5. It goes without saying that the container 2 does not have to be designed as a hollow cylinder, but can basically be of any other suitable form. In this arrangement a mixture of refrigerant 16 and lubricant 6, loaded with lubricant 6, is supplied to the second zone via a feed line 181 from a vaporizer 18 of the refrigeration machine K, and is separated in the second zone 5 of the container 2, so that essentially lubricant-free refrigerant 16 reaches the first zone 4 of the container 2 and is collected there in the container 2 in liquid form. In the operating state the liquid refrigerant 16 can be sucked out from the first zone 4 again via a connecting line 191 by a refrigerant circulation pump 19 and returned to the refrigerant circuit of the refrigeration machine K. A gaseous refrigerant phase 161, which is formed above the liquid refrigerant 16 in the container 2, is sucked up from the first zone 4 of the container 2 by the compressor 17 of the refrigeration machine K via a further connection line 171 and thus returned to the refrigerant circuit.

The sheet metal partition 3, which divides the hollow cylinder-shaped container 2 into first and second zones, is according to the drawing arranged at the bottom of the container 2 in such a way that the refrigerant 16, which is led to the second zone 5 of the container 2, is initially retained by the sheet metal partition 3 in the second zone 5. Only when the liquid level of the refrigerant 16 brought into the second zone 5 of the container 2 has reached the level H of the sheet metal partition 3 can the refrigerant 16 pass over the sheet metal partition 3 and thus reach the first zone 4 of the container 2. By this means the level of refrigerant in the first zone 4 of the container 2 can fluctuate freely, whereby an ideal degree of filling of the refrigerant circuit of the refrigeration machine K is always guaranteed.

A sheet metal separating member 7 is arranged in the second zone 5 for the separating out of the lubricant 6 from the refrigerant 16 in such a way that the second zone 5 is divided into a separating zone A and a overflow zone U, which guarantees that refrigerant 16 can reach the overflow zone U from the separating zone A. This is achieved in the preferred embodiment illustrated here in that the sheet metal partition 3 is designed in such a way and arranged in the hollow cylinder-shaped container 2 so centrally that, in accordance with the drawing, the refrigerant 16 can only reach the overflow zone U from the separating zone A by passing below the sheet metal separating member 7. Gaseous refrigerant 161 can on the other hand flow freely above the sheet metal separating member 7 from the separating zone A into the overflow zone U and into the first zone 4 and is sucked up there by the compressor 17 in the usual manner.

It is preferred, although not necessary, for the sheet metal partition 3 and the sheet metal separating member 7 to be arranged parallel to one another, as shown in FIG. 1. The overflow zone U is located between the sheet metal partition 3 and the sheet metal separating member 7, while the separating zone A is defined by the remaining part of the second zone 5.

An essentially identical level of liquid settles in the overflow zone U and in the separating zone A, wherein the level of liquid is predetermined by the design of the sheet metal partition 3, in other words essentially by its level H. The mixture of refrigerant 16 and lubricant 6, loaded with lubricant 6, separates in the separating zone A due to the different densities of lubricant 6 and refrigerant 16 under the influence of the gravity into two layered liquid phases.

Thus, as shown in the drawings, due to its lower density, the lubricant 6 collects in a substantially single phase lubricant layer 61 in the separating zone A on the surface of the liquid, which the pool 162 of the refrigerant 16 forms, and is thus prevented from reaching the overflow zone U and thus the first zone 4 by the sheet metal separating member 7.

A extraction stub 9 is arranged in the separating zone A at the level H of the surface of the liquid, the position of which is defined by the level H of the sheet metal partition 3, and is eccentrically arranged in relation to a longitudinal axis L of the container 2. In this arrangement the extraction stub 9 can of course be arranged differently in a suitable manner in relation to the longitudinal axis L. The extraction stub 9 is suitable for extracting the lubricant 6 from the lubricant layer and for removing it from the container 2 via the line 11.

Figure 2:
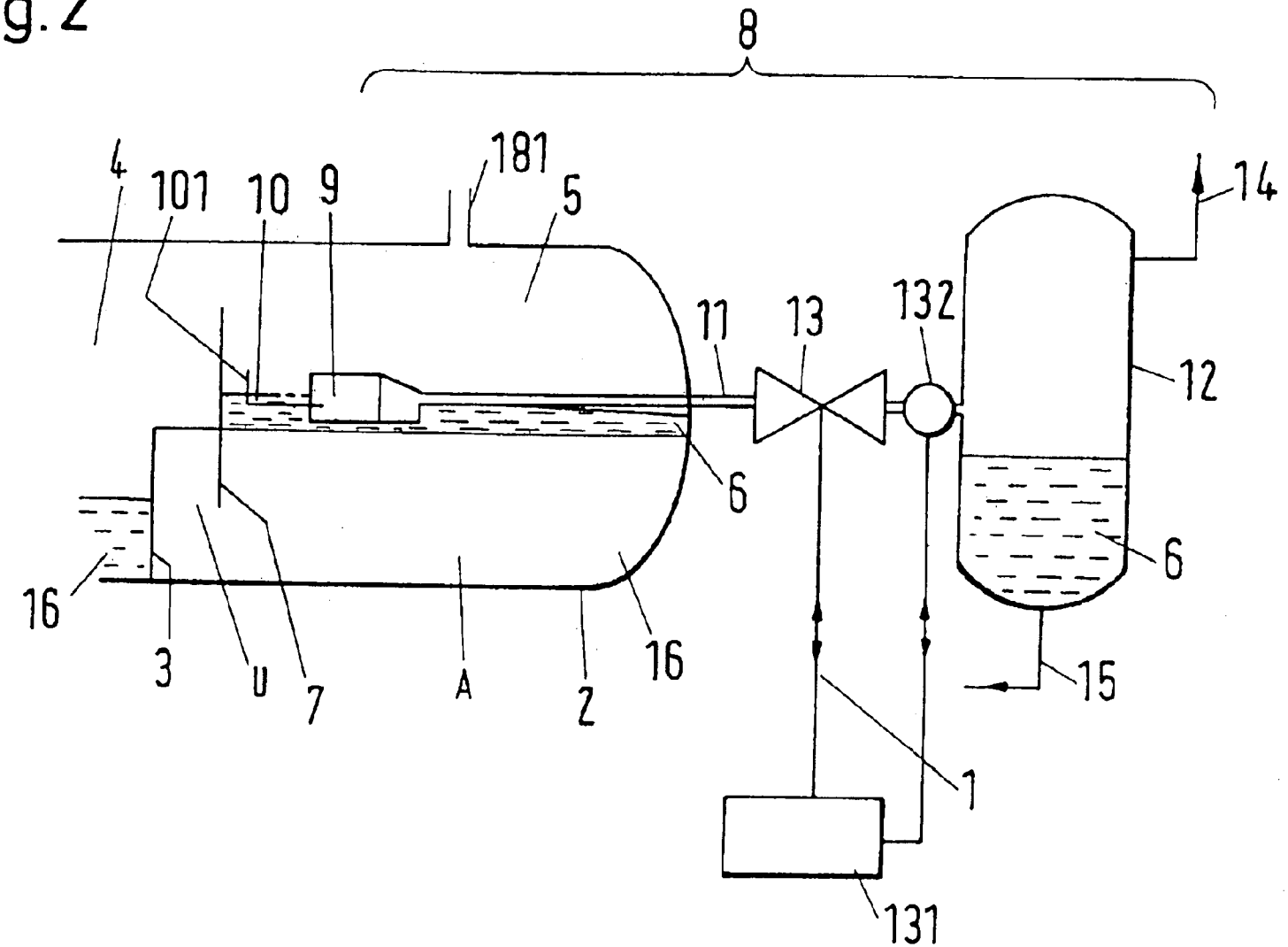
FIG. 2 shows a preferred embodiment of an apparatus for the return of lubricant shown schematically

FIG. 2 shows a preferred embodiment of an apparatus for the return of lubricant 1 in accordance with the invention. A sheet metal lubricant catcher 10 is additionally arranged between the sheet metal separating member 7 and the extraction stub 9, and in particular has an angled region, preferably circa 5 mm to 10 mm wide and in particular executed as an outwardly turned over rim 101, which additionally assists and facilitates the leading away of the lubricant 6. Furthermore, the extraction device 8 has a collecting container 12 for the lubricant 6, with the extraction stub 9 being connected to the collecting container 12 via the line 11. Furthermore, the collecting container 12 has a first removal line 14 for the return of residues of the refrigerant 16, which are separated from the lubricant 6 in the collecting container 12, into the refrigerant circuit, and also a second removal line 15, by means of which the lubricant 6 can be returned into the lubricant circuit of the refrigeration machine K.

The extraction device 8 advantageously includes a valve 13 for the control and/or regulation of the amount of lubricant 6 to be removed from the container 2, the valve 13 being provided in the line 11 between the extraction stub 9 and the collecting container 12, and also a control unit 131 for operating the valve 13.

Furthermore, a pump 132 is provided in the line 11, which assists the draining of the lubricant 6 from the separating zone A of the container 2 into the collecting container 12.

The suggested return of lubricant for a refrigeration machine thus permits a lubricant, which is lighter than the refrigerant used in the refrigeration machine, to be separated from the refrigerant itself in a simple and reliable manner and simultaneously optimizes the filling of the refrigeration machine with refrigerant.

We claim:

1. An apparatus for the return of lubricant for a refrigeration machine comprising a container with at least one sheet metal partition, said sheet metal partition dividing the container into at least a first zone and a second zone, as well as a sheet metal separating member arranged in the second zone for separating out lubricant, wherein in the second zone an extraction device is arranged in relation to the sheet metal separating member in such a way and formed so that the lubricant separated out at the sheet metal separating member is removable from the container by means of the extraction device, the extraction device comprising an extraction stub for receiving the lubricant.

2. An apparatus for the return of lubricant in accordance with claim 1, in which a sheet metal lubricant catcher is arranged between the sheet metal separating member and the extraction device.

3. An apparatus for the return of lubricant in accordance with claim 1, wherein the extraction device includes a collecting container for the lubricant connected with the extraction stub via a line.

4. An apparatus for the return of lubricant in accordance with claim 1, wherein, in the operating state, the lubricant is an oil which is essentially non-soluble in the refrigerant.

5. An apparatus for the return of lubricant in accordance with claim 1, wherein the refrigerant is carbon dioxide.

6. A refrigeration machine with a lubricant return in accordance with claim 1.

7. A refrigeration machine in accordance with claim 6 with a compressor and a vaporizer, wherein the lubricant return is arranged between the compressor and the vaporizer.

8. An apparatus for the return of lubricant for a refrigeration machine comprising a container with at least one sheet metal partition, said sheet metal partition dividing the container into at least a first zone and a second zone, as well as a sheet metal separating member arranged in the second zone for separating out lubricant, wherein in the second zone an extraction device is arranged in relation to the sheet metal separating member in such a way and formed so that the lubricant separated out at the sheet metal separating member is removable from the container by means of the extraction device, and a sheet metal lubricant catcher arranged between the sheet metal separating member and the extraction device.

9. An apparatus for the return of lubricant in accordance with claim 8, in which the extraction device comprises an extraction stub for receiving the lubricant.

10. An apparatus for the return of lubricant for a refrigeration machine comprising a container with at least one sheet metal partition, said sheet metal partition dividing the container into at least a first zone and a second zone, as well as a sheet metal separating member arranged in the second zone for separating out lubricant, wherein in the second zone an extraction device is arranged in relation to the sheet metal separating member in such a way and formed so that the lubricant separated out at the sheet metal separating member is removeable from the container by means of the extraction device, the extraction device including a collecting container for the lubricant connected with an extraction stub via a line.

11. An apparatus for the return of lubricant in accordance with claim 10, wherein a valve is provided in the line for the control and/or regulation of the amount of lubricant to be extracted from the container.

12. An apparatus for the return of lubricant in accordance with claim 10, wherein the collecting container includes means and is formed in such a way that residues of a refrigerant can be separated from the lubricant.

* * * * *